US007793579B1

(12) United States Patent
Lee

(10) Patent No.: US 7,793,579 B1
(45) Date of Patent: Sep. 14, 2010

(54) ARMOR TILE

(76) Inventor: Robert G. Lee, 4344 SW. Chesapeake Ave., Portland, OR (US) 97239

( * ) Notice: Subject to any disclaimer, the term of this patent is extended or adjusted under 35 U.S.C. 154(b) by 0 days.

(21) Appl. No.: 12/186,508

(22) Filed: Aug. 5, 2008

Related U.S. Application Data

(60) Provisional application No. 60/954,017, filed on Aug. 5, 2007.

(51) Int. Cl.
*F41H 5/02* (2006.01)

(52) U.S. Cl. ..... 89/36.02; 89/903

(58) Field of Classification Search ..... 89/36.02; 429/911; 114/271

See application file for complete search history.

(56) References Cited

U.S. PATENT DOCUMENTS

| | | | | | |
|---|---|---|---|---|---|
| 274,354 | A * | 3/1883 | Cumming | 52/591.4 |
| 1,268,223 | A * | 6/1918 | Eimer | 2/2.5 |
| 1,767,081 | A * | 6/1930 | Korber | 428/39 |
| 3,867,239 | A * | 2/1975 | Alesi et al. | 428/48 |
| 4,198,707 | A * | 4/1980 | Haupt et al. | 2/2.5 |
| 4,241,457 | A | 12/1980 | Klein et al. | |
| 4,483,020 | A | 11/1984 | Dunn | |
| 4,633,756 | A | 1/1987 | Rudoi | |
| 4,660,223 | A | 4/1987 | Fritch | |
| 4,757,742 | A | 7/1988 | Mazelsky | |
| 4,825,618 | A * | 5/1989 | Blevins | 52/592.5 |
| 5,102,607 | A | 4/1992 | Hickman et al. | |
| 5,404,793 | A * | 4/1995 | Myers | 92/169.1 |
| 5,503,795 | A | 4/1996 | Hubbard | |
| 5,515,541 | A * | 5/1996 | Sacks et al. | 2/2.5 |
| 5,698,149 | A | 12/1997 | Hinzmann et al. | |
| 5,771,489 | A * | 6/1998 | Snedeker | 2/2.5 |
| 5,772,748 | A | 6/1998 | Hubbard | |
| 5,804,757 | A | 9/1998 | Wynne | |
| 5,915,528 | A * | 6/1999 | Shmuelov | 2/2.5 |
| 5,996,115 | A | 12/1999 | Mazelsky | |
| 6,035,438 | A | 3/2000 | Neal et al. | |
| 6,170,378 | B1 * | 1/2001 | Neal et al. | 89/36.05 |
| 6,318,986 | B1 | 11/2001 | Hinzmann et al. | |
| 6,370,690 | B1 | 4/2002 | Neal | |
| 6,510,777 | B2 | 1/2003 | Neal | |
| 6,745,661 | B1 | 6/2004 | Neal et al. | |
| 6,920,817 | B2 | 7/2005 | Ravid et al. | |
| 7,067,031 | B2 * | 6/2006 | deWitt | 156/250 |
| 7,143,452 | B1 * | 12/2006 | Rossini | 2/209.13 |
| 7,500,422 | B2 * | 3/2009 | Mazur | 89/36.02 |

* cited by examiner

*Primary Examiner*—Bret Hayes
*Assistant Examiner*—Reginald Tillman, Jr.
(74) *Attorney, Agent, or Firm*—Klarquist Sparkman, LLP

(57) ABSTRACT

A ballistics armor system comprises plural tiles having overlapping edge portions.

25 Claims, 27 Drawing Sheets

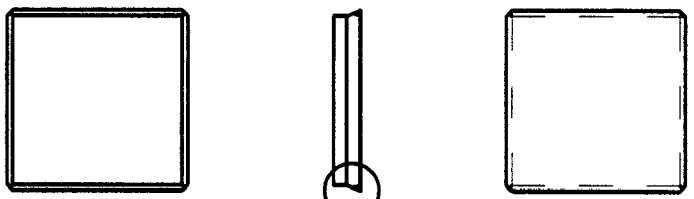
Fig. 1f
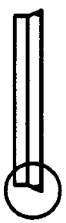
Fig. 1g
Fig. 1h
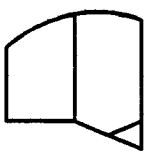
Fig. 1i
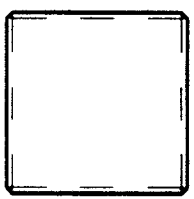
Fig. 1j
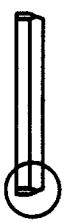
Fig. 1k
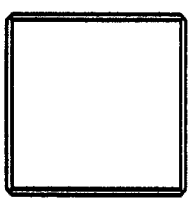
Fig. 1l
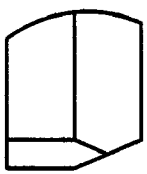
Fig. 1m

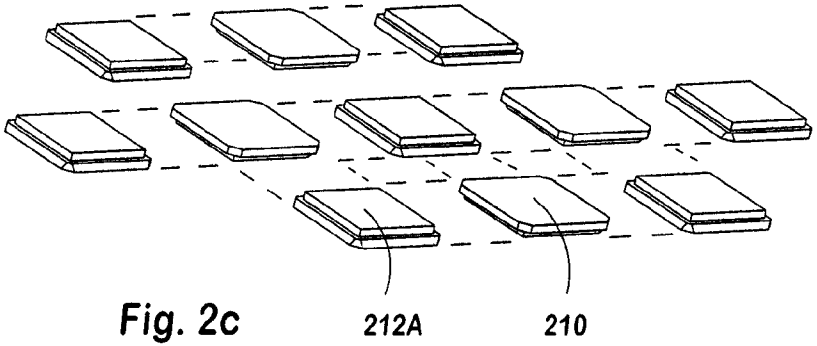
Fig. 2c
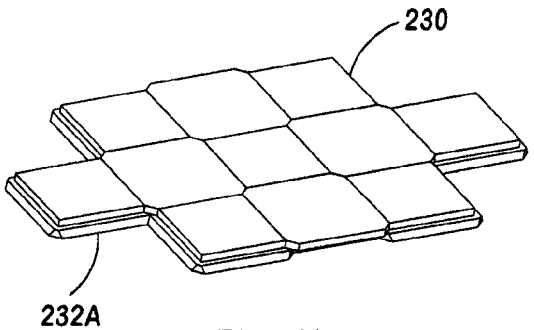
Fig. 2b
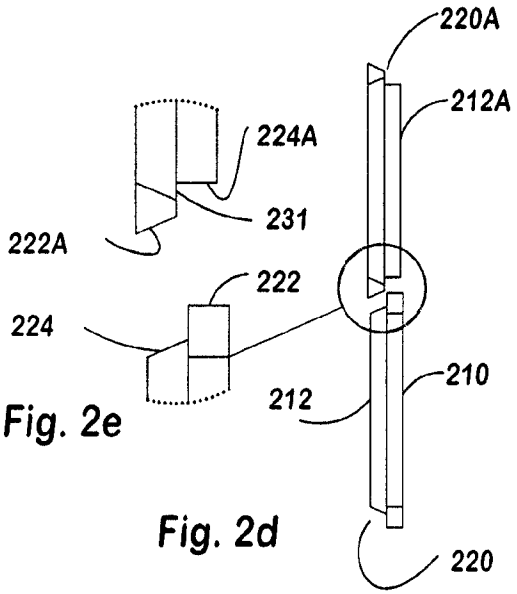
Fig. 2d
Fig. 2e
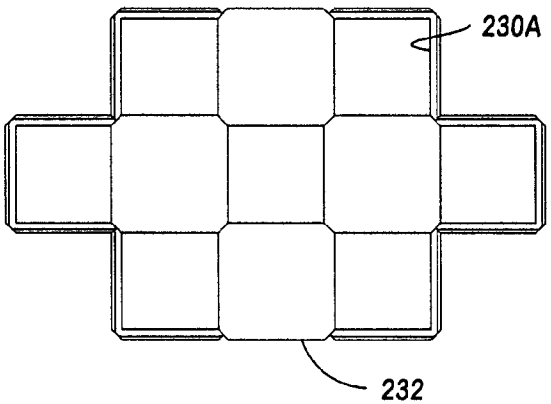
Fig. 2a

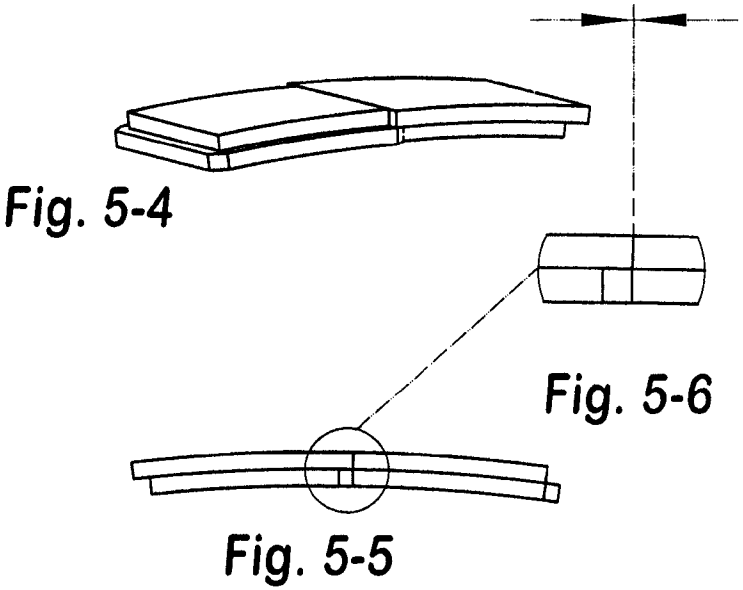
Fig. 5-4
Fig. 5-5
Fig. 5-6
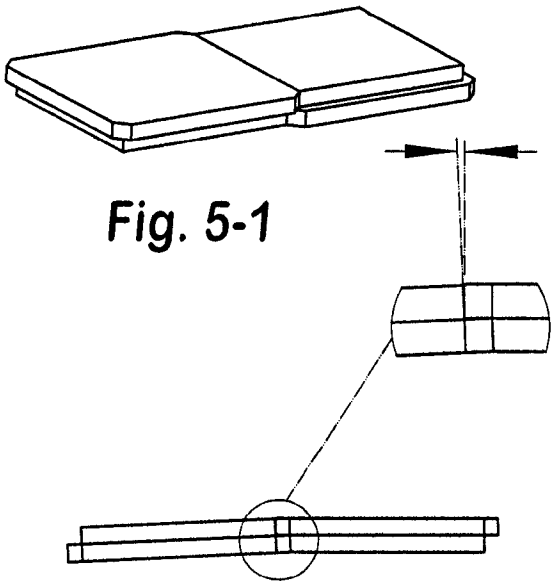
Fig. 5-1
Fig. 5-2
Fig. 5-3

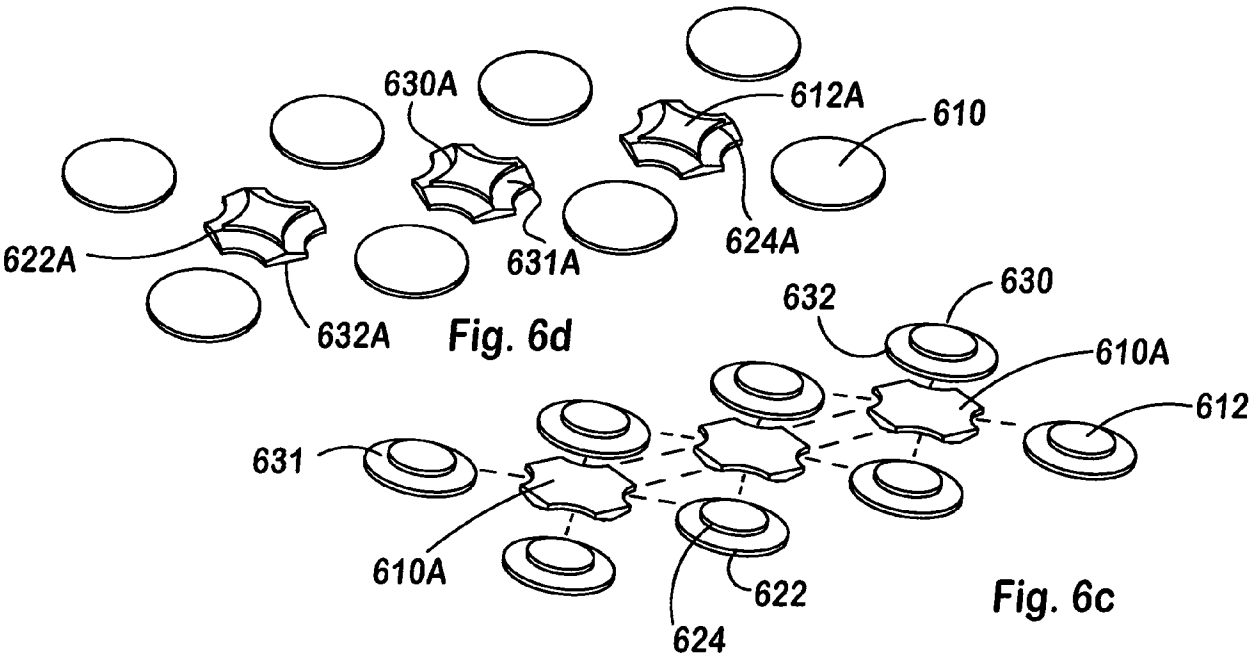
Fig. 6d
Fig. 6c
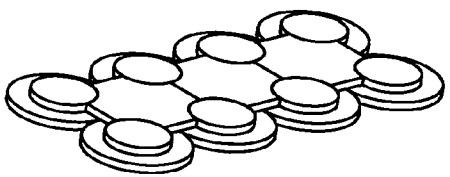
Fig. 6b
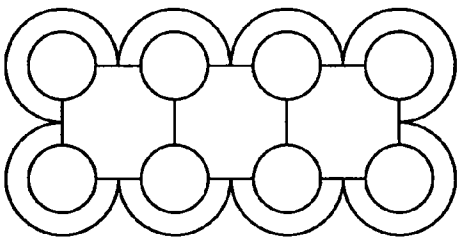
Fig. 6a

ARMOR TILE

CROSS REFERENCE TO RELATED APPLICATION

This claims the benefit of U.S. Provisional Application No. 60/954,017, filed Aug. 5, 2007.

BACKGROUND AND SUMMARY

Protective armor systems typically incorporate multiple armor tiles, commonly ceramic tiles. In the case of body armor garments for personal use, armor tiles typically are supported within a fabric structure such as a vest as shown in U.S. Pat. No. 5,996,115 to Mazelsky.

In some instances an armor tile may be a large ceramic piece. In the case of a personal body armor garment, such a piece may be shaped to cover a critical body area for protection. The large ceramic tile has a deficiency in that when hit in one area, cracks are likely to propagate to beyond the initial impact area, perhaps crack the entire tile. When damaged the entire tile must be replaced which is costly and not practical in field situations.

In other instances, the tiles are relatively small and are in shapes such as squares, rectangles, triangles, rounds and other polygon shapes. Tiles of smaller polygon shapes can be secured together side-by-side by various methods and/or laminated in fabrics. But in many cases leave gaps straight through the garment between tiles or have other deficiencies. Various tile designs and methods of sealing gaps have been described in the past, but none that provides an optimal construction.

Other systems have employed numerous small tiles that overlap one another as opposed to being arranged in a common plane. But overlapping the full thickness of tiles adds a significant amount of weight. Further, because there are no edge restraints either vertically or horizontally on such overlapping arrangements, the tiles can be pushed off the horizontal plane perhaps as much as 90 degree when hit with a projectile, or from normal movement if not restrained, thereby creating an open space vulnerable to a second hit.

The present disclosure concerns tiles that easily can be constructed and that can be assembled edge-to-edge into armor structures that do not suffer from the problems of prior armor systems and armor tiles.

BRIEF DESCRIPTION OF THE DRAWINGS

In the drawings:

FIGS. 1*a*-1*m* are views of a first tile system.
FIGS. 5-1-5-11 are views of a sixth tile system.
FIGS. 6*a*-6*m* are views of a seventh tile system.

DETAILED DESCRIPTION

Figure 1C:
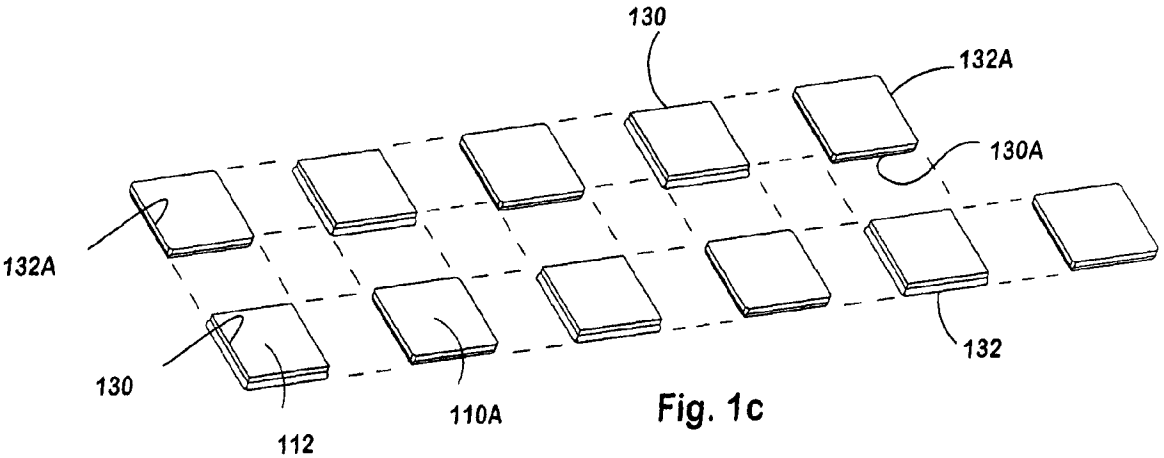
Figure 1B:
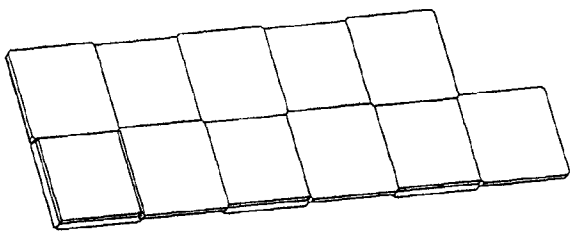
Figure 1A:
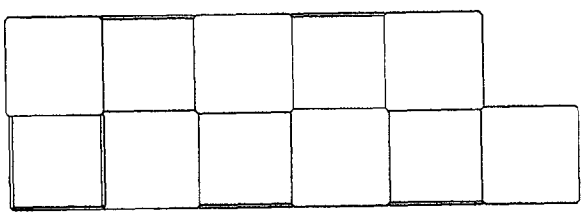
Figure 1D:
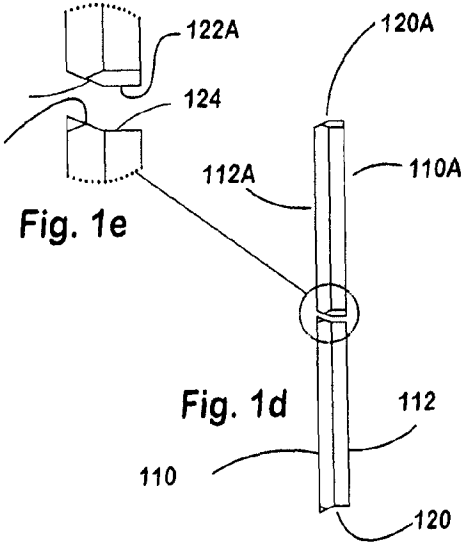
Figure 1E:
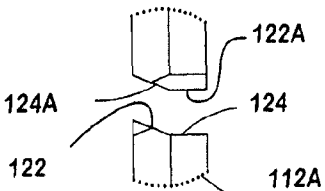
Figure 2J:
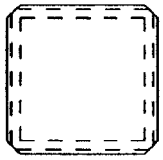
FIGS. 2*a*-2*o* are views of a second tile system.
Figure 2I:
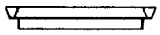
Figure 2H:
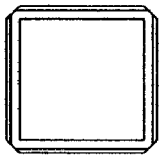
Figure 2G:
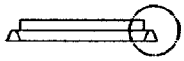
Figure 2F:
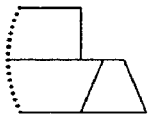
Figure 2O:
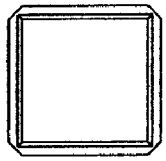
Figure 2N:
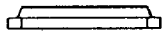
Figure 2M:
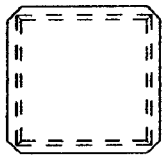
Figure 2L:
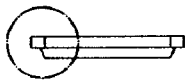
Figure 2K:
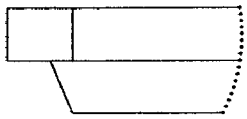

Described herein are tiles having edge designs that allow overlapping of the edges of the tiles only, thereby eliminating disadvantages of certain prior tile systems wherein the full thickness of tiles overlap.

The tile edges are configured such that an expanse of tiles, aligned edge-to-edge, can be formed. Openings straight through the expanse are avoided, some flexibility between adjacent tiles is possible, and the tiles can have some curvature. The amount of flexibility and curvature will depend on the angles and radii used in the joint design and the size of the gap between tiles that would be acceptable for any given application.

Multi-hit capacity is increased because the plurality of relatively small tiles are not directly connected to one another, thereby reducing crack propagation. Using such tiles it is possible to cut out and replace a small area in the field rather than having to replace a larger tile. And with tile systems described herein, there is a reduced potential for a tile to be pushed aside, off the horizontal plane, when hit.

An overlapping joint system for ballistics armor tile allows for increased flexibility, increased multi hit capability, increased protection at seams and reduced weight by eliminating the need to overlap the full thickness of tiles.

Such tiles best are configured to allow construction from very hard materials such as the various ceramics tiles now in use. The edge joint best will be pressed into the tile by conventional pressing methods in the green state prior to firing or sintering with that configuration retained in the final part reducing or eliminating the need for final machining. In some instances the hard materials used for ballistics applications are so hard and tough that machining is not practical or cost effective.

Edge Shape Properties

Each tile has an edge shape that allows adjacent tiles to fit together so as to form an armor structure that has close fitting seams between tiles, without cracks or gaps that extend straight through the armor structure at about 90° to a face of the structure, or in the case of curved structure, not at about 90° to a tangent where it touches a face of the curved structure. The edge shape also allows adjacent tiles to interengage in such a manner that adjacent tiles can tilt to some extent relative to each other. The armor structure thus can have some flexibility.

The mating edges can be of one of two types—"symmetric" and "asymmetric." Symmetric edge designs allow a single tile to be "turned over" and fit to adjacent tiles. Asymmetric edge tiles do not conveniently invert and require at least two types of tiles used in pairs to fit together to form a plane of tiles.

Advantageously, in symmetric edge tiles, the edge profiles are uniform over half the material thickness. This means that in order to be able to "flip the tile over" and have the flat faces of abutting tiles in alignment, the edge profile must be minor symmetric about a plane passing horizontally through the mating edge of the tile.

Symmetric tiles are shown in FIGS. 4, 5*a*-5*l*, 7, 8, and 10. Asymmetric tiles are shown in FIGS. 1, 2, 3, 5-1-5-11, 6, and 9.

Curvature

Edges may be either curved or straight, as viewed looking toward a face surface of a tile. FIGS. 6*a*-6*m* and 9*a*-9*m* show round tile shapes with curved interface edges. FIGS. 1, 2, 4, 5, 7 and 8 show tiles having straight edges.

FIG. 3 is a unique combination of a radius formed edge lying along a straight path and is a hybrid of curved and straight design.

Corner Interference

Straight edged tiles exhibit experience corner interference. Corner interference prevents the tiles from fitting closely together with tight seams. As shown in FIGS. 3*d*, 3*e*, 4*d*, 5*d*, 7*b*, and others, the corners of such tiles can be truncated to avoid interference. Each tile shape has one or more unique corner interference conditions which dictate the extent of truncation required.

Overlap

Overlap is the property of an edge of one tile one the overlaying an edge of another tile when viewed facing a flat face of an armor structure.

Overlap may affect the shock absorbing properties of the assembly of tiles. All the shapes shown may be produced with varying amounts of overlap.

Interface

The edges of the illustrated tiles have one of three basic shape types—flat, radius or angled.

Angled shapes may have a plurality of angles that vary from design to design. For example, the tiles of FIGS. 7*a*-7*k*, of FIGS. 7*l*-7*o*, and of FIG. 8 are the same basic design, but the angles between adjacent edge surfaces are different.

The edge design may be applied without regard to the size, large or small, with the limitation being dependant on the capacity of the equipment used to make or form the tile.

Configuration

The illustrated tiles can be generally described as having the shape of a frustum of a pyramid. Referring for example to FIGS. 5*a*-5*l*, each tile is a body having a base surface or "major face surface" 510 and an apex surface or "minor face surface" 512. One or more lateral faces or "edge surfaces" 520 flare progressively, either continuously or in steps, from the minor face surface 512 to the major face 510 surface without any undercut portion. (The numbering of similar elements in various sets of drawings is the same, but numbers are incremented by 100 from drawing set to drawing set for various illustrated embodiments configurations.)

In the illustrated tiles the major and minor face surfaces generally are everywhere equidistant. Although the major and minor face surfaces best are substantially continuous, one or both of the face surfaces may define a cavity for the purpose of weight reduction or may have a surface texture shaped to deflect an incident projectile. The major and minor face surfaces also may be somewhat curved, as shown in FIGS. 5-1-5-11, for better fit in applications such as vests.

Figures 5A, 5B, 5C, 5D, 5E, 5F:
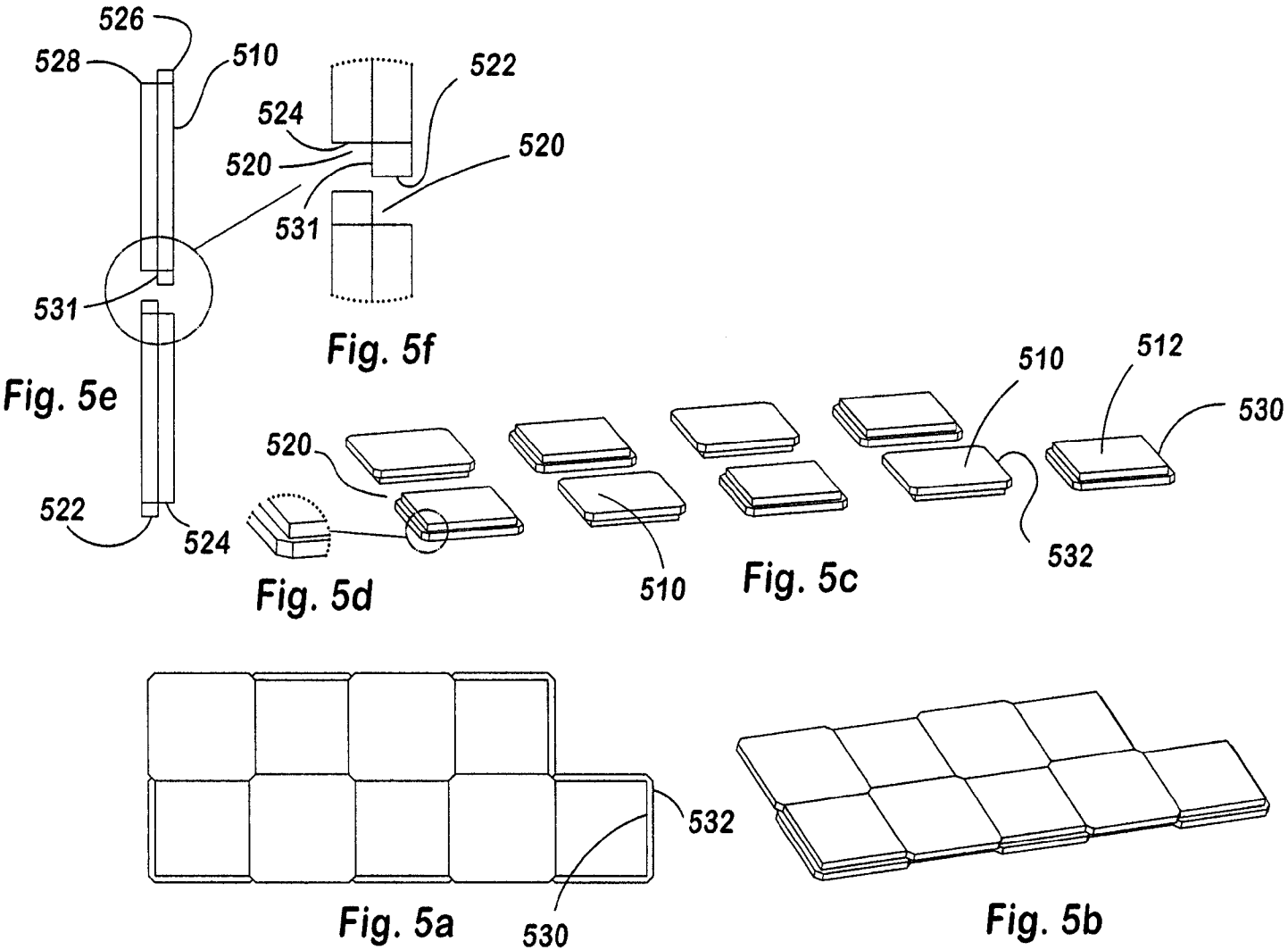
FIGS. 5*a*-5*l* are views of a fifth tile system.
Figure 5I:
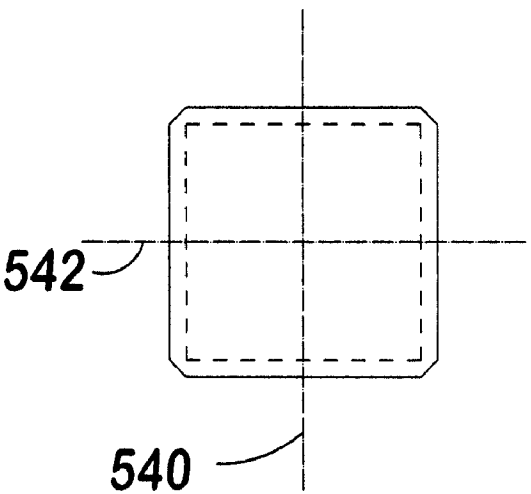
Figure 5H:
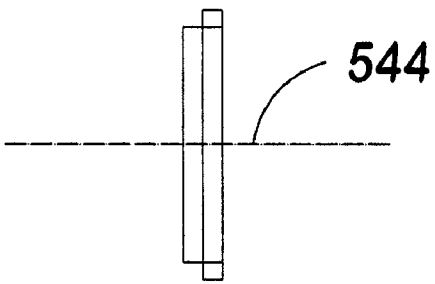
Figure 5G:
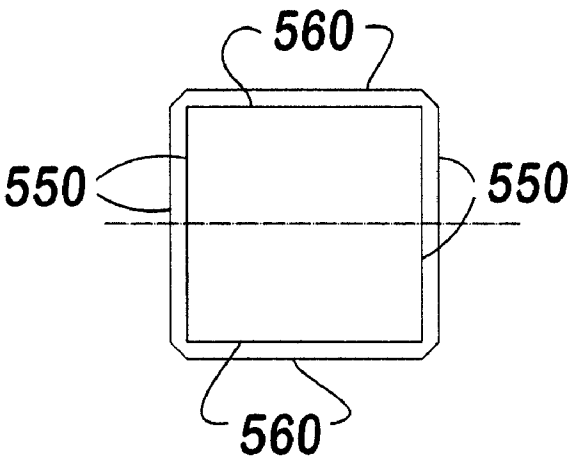
Figures 5, 6, 7, 8, 9:
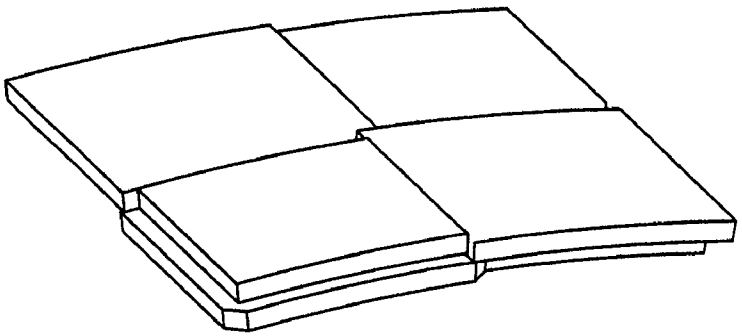
Figure 5J:
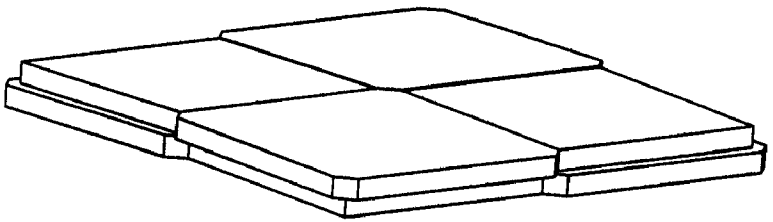
Figures 5, 6, 7, 8, 9, 10:
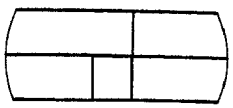
Figures 5, 6, 7, 8, 9, 10, 11:
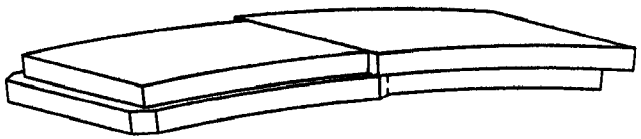

The minor face surface 512 has a smaller area than the major face surface 510 and is positioned such that the perimeter 530 of the minor face surface does not extend outwardly of the perimeter 532 of the major face surface when the body is viewed facing the minor face surface as in FIG. 5*a*. The edge surface or surfaces are sloped, as for example shown in FIGS. 4*a*-4*j*, and/or stair stepped, as for example shown in FIGS. 5*a*-5*l*, between the major and minor face surfaces due to the differences in areas and perimeters of the face surfaces.

In all of the illustrated the tiles, except the tile shown in FIGS. 4*a*-4*j*, the shape of the tile is specifically that of a "step pyramid." In a step pyramid shape, the entirety of an edge surface does not lie in a single plane.

Although possibly advantageous, no portion of any edge surface of a pyramidal tile need be planar or extend absolutely perpendicularly or in parallel to the to the major and minor face surfaces.

Figures 3A, 3B, 3C, 3D, 3E, 3F, 3G:
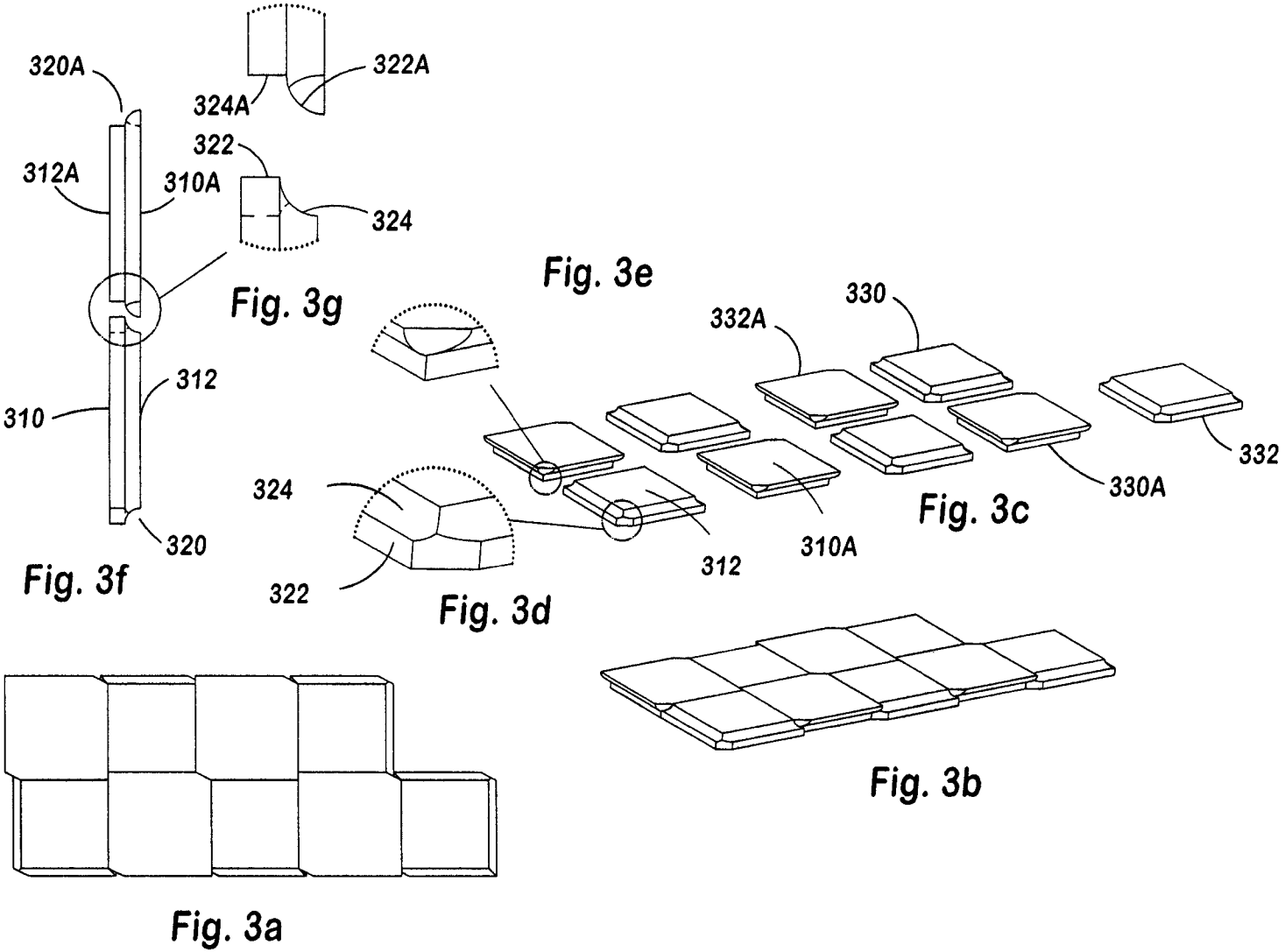
FIGS. 3*a*-3*p* are views of a third tile system.
Figure 3K:
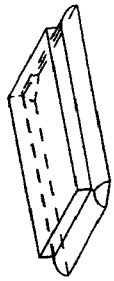
Figure 3P:
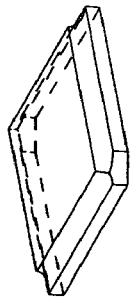
Figure 3J:
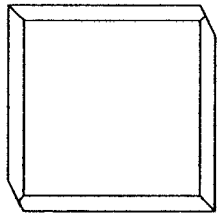
Figure 3O:
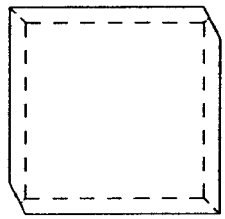
Figure 3I:
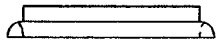
Figure 3N:
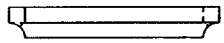
Figure 3H:
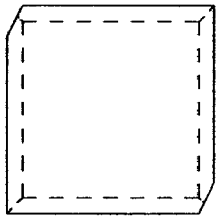
Figure 3M:
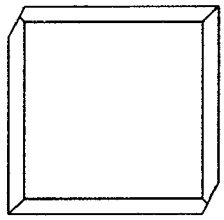
Figure 3L:
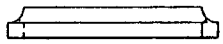
Figures 4A, 4B, 4C, 4D, 4E, 4F:
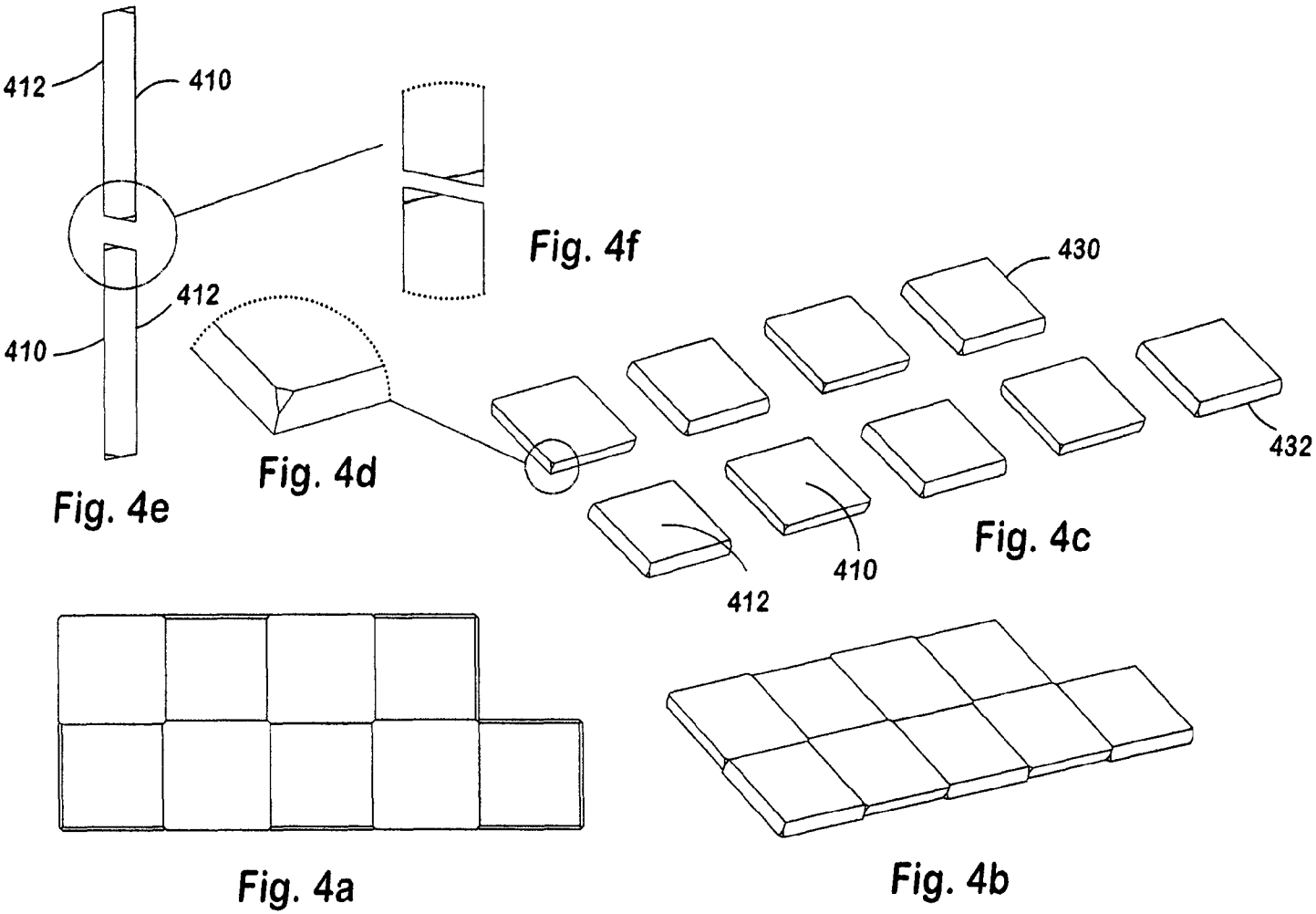
FIGS. 4*a*-4*j* are views of a fourth tile system.
Figure 4J:
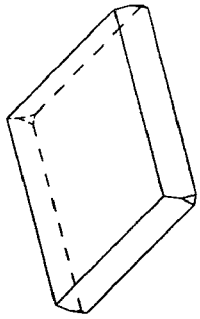
Figure 4I:
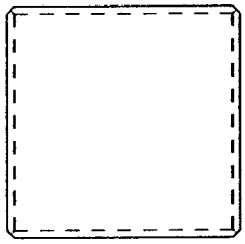
Figure 4H:
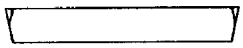
Figure 4G:
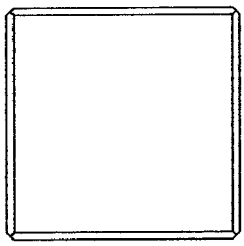

The edge surface or surfaces may have two or more different portions or bands, shown at 522, 524 in FIGS. 5*a*-5*l*, that are of generally uniform width around the entire perimeter of the tile. Advantageously at least two of such portions or bands have different profiles as shown in FIGS. 3*a*-3*p* and/or extend at an angle relative to each other as shown in FIGS. 1*a*-1*m*. With these arrangements, adjacent tiles are less prone to slip relative to each other, as compared to systems where the edge surfaces are completely planer, when the armor system is impacted or when the wearer of a personal armor garment moves about.

The edge surface or surfaces are in the nature of steps comprised of major and minor corner bands 522, 524 extending from the perimeters of the major and minor face surfaces 510, 512 respectively. Each corner band 522, 524 extends at an angle from its corresponding face surface 510, 512 such that the corner band and the face surface meet at a corner 526, 528. In the advantageous system of FIGS. 5*a*-5*l*, both the corner bands 522, 524 extend generally perpendicularly to the face surfaces 510, 512. Corner bands are sometimes referred to herein as first and second surface portions.

Advantageously the edge surface or surfaces may also comprise one or more bridging bands, shown at 531 in FIGS. 5*a*-5*l*, that extend between the first and second corner bands 522, 524. A bridging band is sometimes referred to herein as a third surface portion. In some of the illustrated tile systems, as shown for example in FIGS. 5*a*-5*l*, a single bridging band extends substantially parallel to the face surfaces between the first and second corner bands. In other of the illustrated tile systems, as shown for example in FIGS. 7*a*-7*o*, a single bridging band extends at an angle other than about 90° to the face surfaces between the first and second corner bands.

A band may be generally planar, as shown in FIGS. 5*a*-5*l*, or may have a curved profile, as shown at 324 in FIGS. 3*a*-3*p*.

Advantageously both the major and minor face surfaces are generally rectangular, as shown in FIGS. 1*a*-1*m*, FIGS. 2*a*-2*o*, FIGS. 3*a*-3*p*, FIGS. 4*a*-4*j*, FIGS. 5*a*-5*l*, FIGS. 5-1-5-11, FIGS. 7*a*-7*o*, FIGS. 8*a*-8*i*, and FIGS. 10*a*-10*f*, with the ratio of the length of the sides of the rectangle being the same for both the major and minor face surfaces. Most advantageously both the major and minor face surfaces are generally square as illustrated.

Advantageously such generally square tiles are generally bilaterally symmetrical about three mirror lines 540, 542, 544. Each of two such mirror lines 540, 542 extends generally in parallel to and midway between each pair 550, 560 of facing perimeter edges of the major and minor face surfaces. And one such mirror line 544 extends generally perpendicular to the major and minor face surfaces at their centers.

Advantageously, both the major and minor face surfaces are centered relative to each other such that the perimeter 530 of the minor face surface is generally everywhere equidistant from the perimeter 532 of the major face surface when the body is viewed facing the minor face surface, as in FIG. 5*a*.

Best results are achieved with edge surfaces 520 that are not grooved or greatly undercut.

Particularly advantageous are the symmetric edge tiles, such as those of FIGS. 5*a*-5*l*, that have an edge surface is profiled such that the edge surfaces of two adjacent tiles conform to one another when two identical tiles are positioned edge-to-edge with the face surfaces of the two tiles facing in opposite directions, such that the major face surface of one tile faces in the same direction as the minor face surface of the adjacent tile as illustrated in FIG. 5*e*.

Figure 5K:
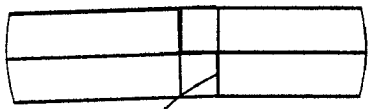
Figure 5L:
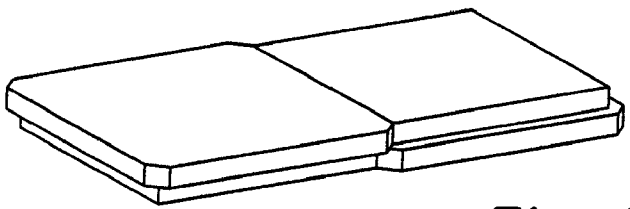
Figures 5, 6, 7:
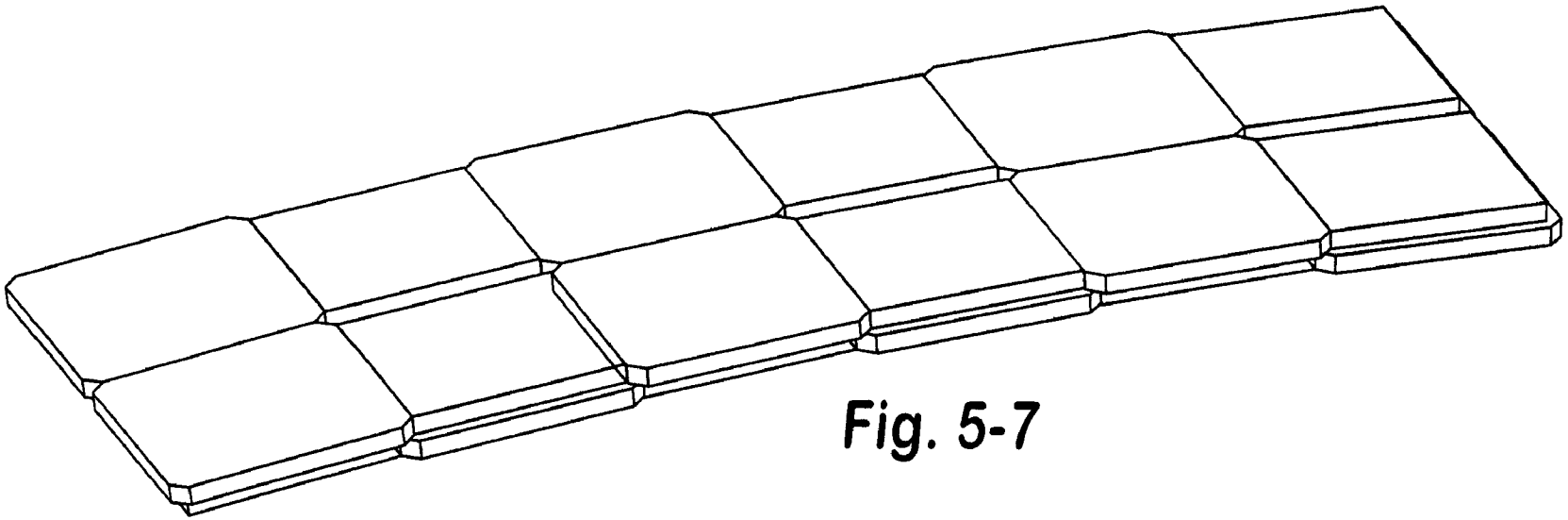
Figures 5, 6, 7, 8:
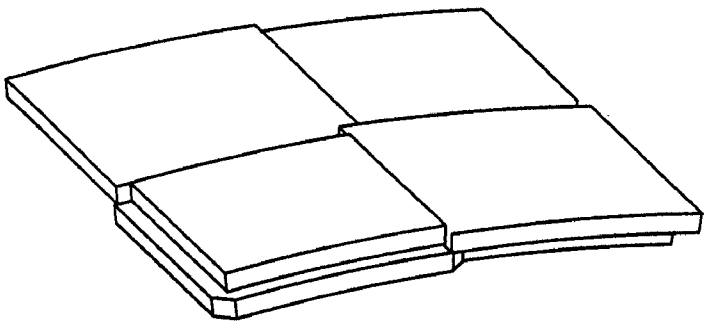
Figure 6G:
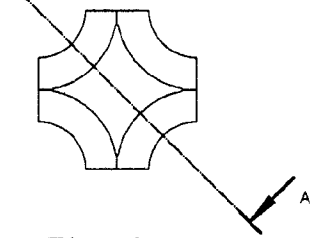
Figure 6H:
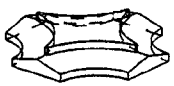
Figure 6I:
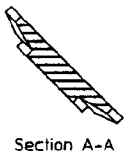
Figure 6E:
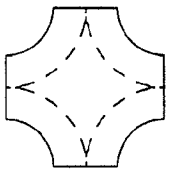
Figure 6F:
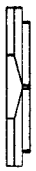
Figure 6L:
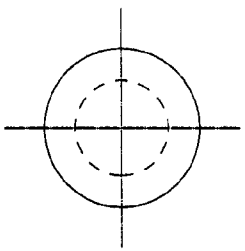
Figure 6M:
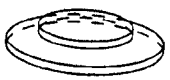
Figure 6J:
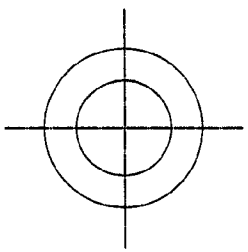
Figure 6K:
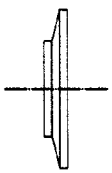
Figures 7A, 7B, 7C, 7D, 7E:
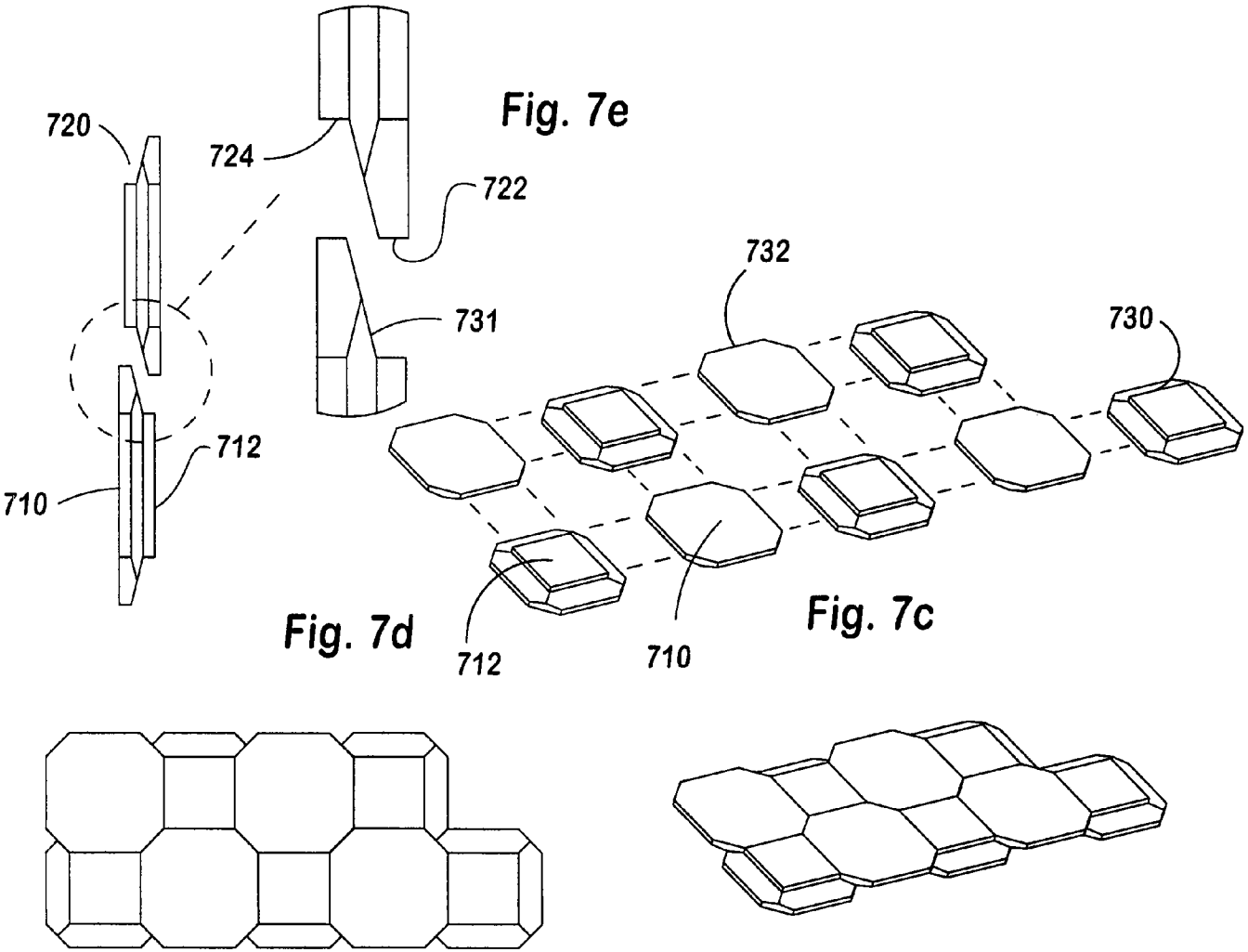
FIGS. 7*a*-7*o* are views of an eighth tile system.
Figure 7I:
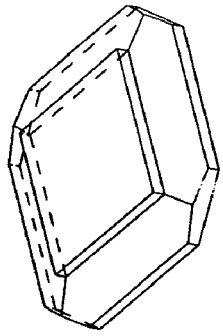
Figure 7H:
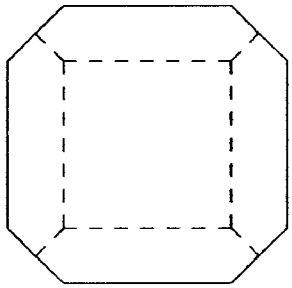
Figure 7G:
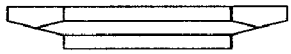
Figure 7F:
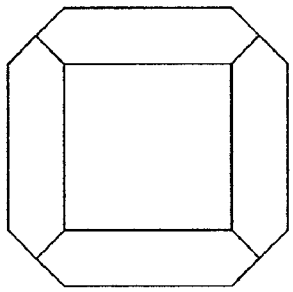
Figures 7J, 7K:
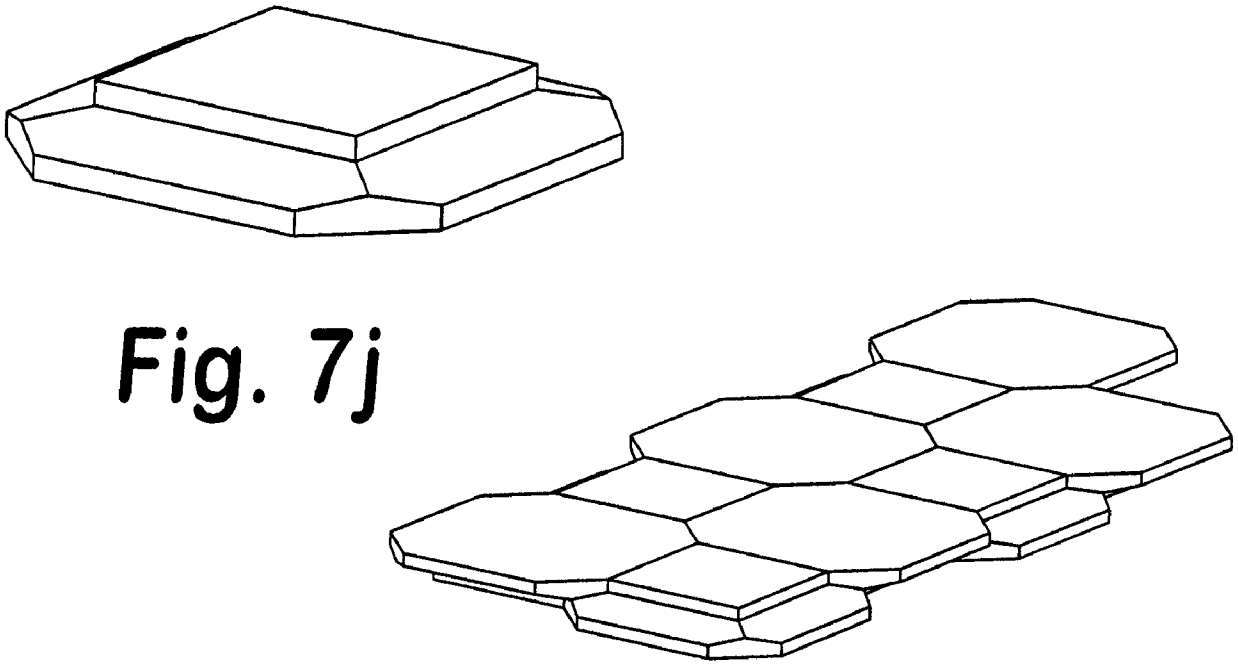
Figure 7M:
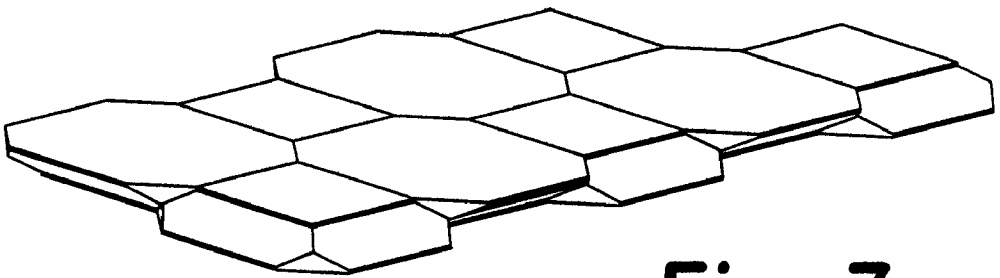
Figure 7L:
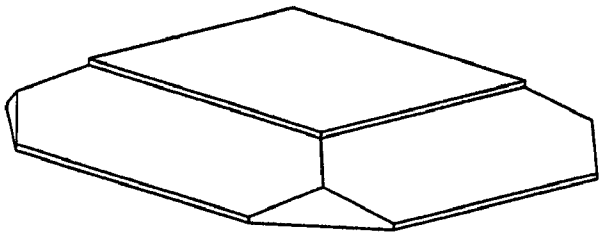
Figure 7O:
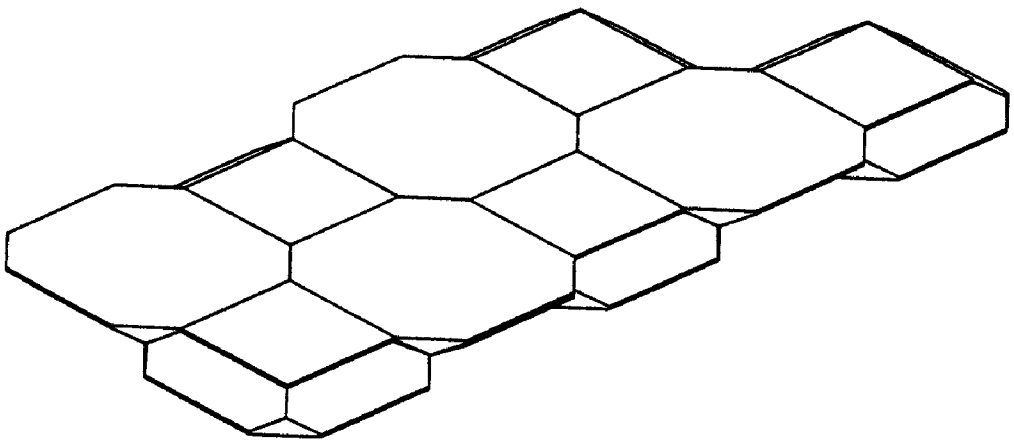
Figure 7N:
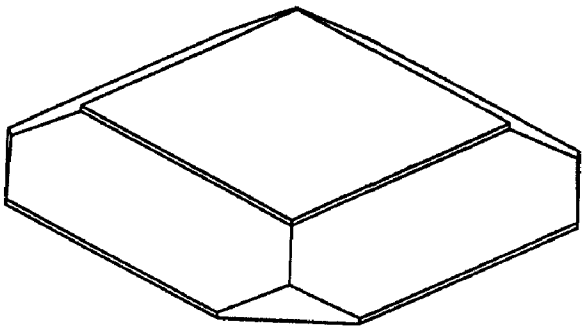
Figures 8A, 8B, 8C, 8D, 8E:
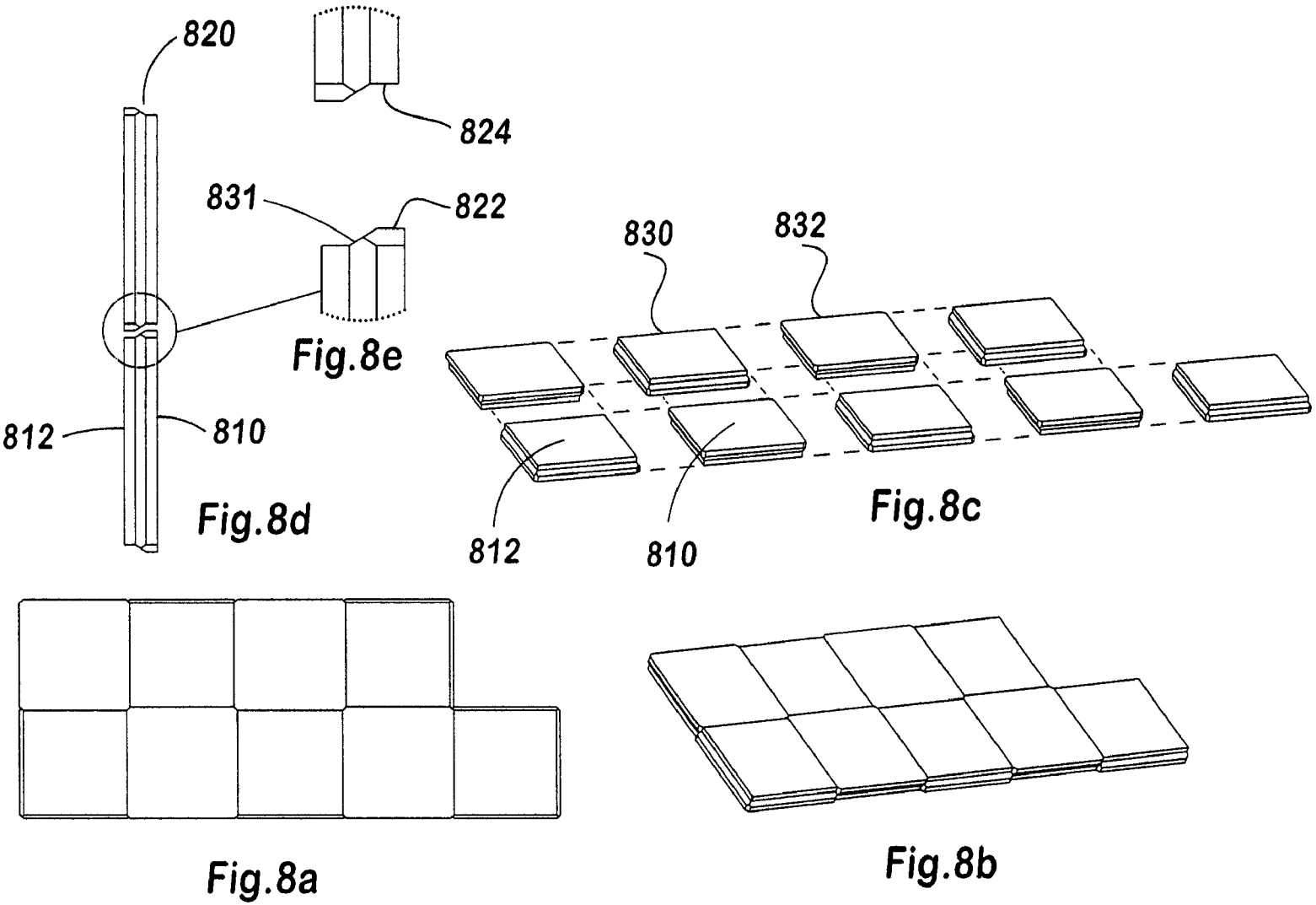
FIGS. 8*a*-8*i* are views of a ninth tile system.
Figure 8I:
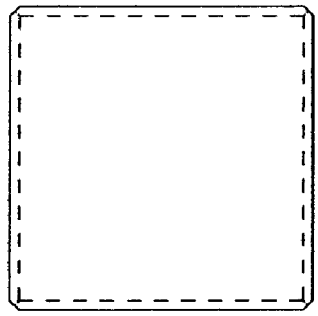
Figure 8H:
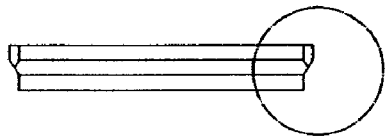
Figure 8F:
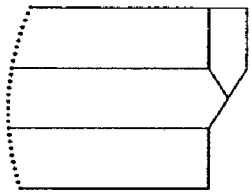
Figure 8G:
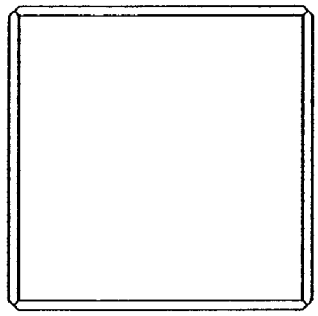
Figures 9A, 9B, 9C, 9D, 9E:
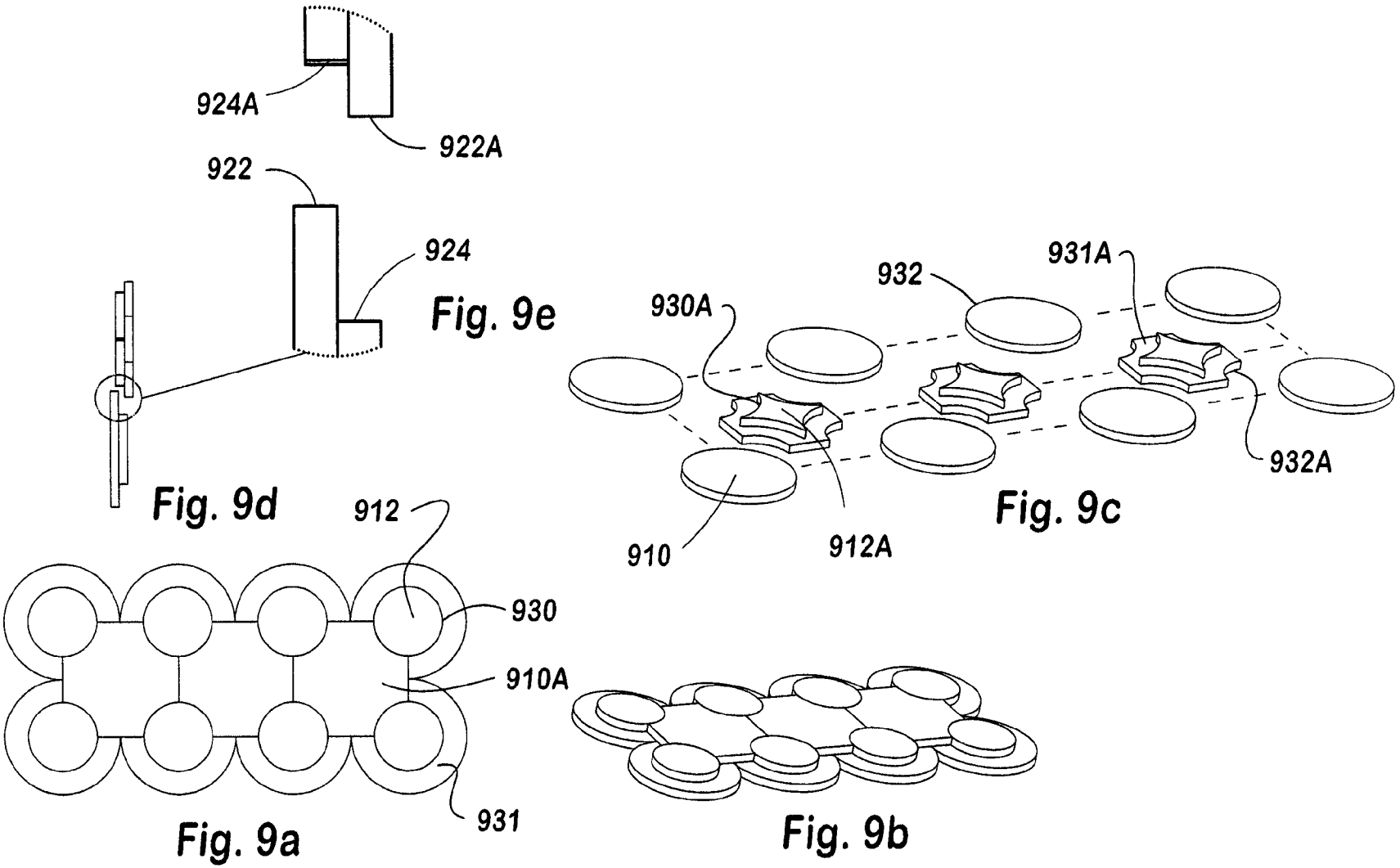
FIGS. 9*a*-9*m* are views of a tenth tile system.
Figure 9F:
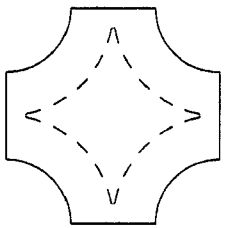
Figure 9G:
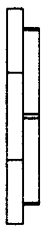
Figure 9H:
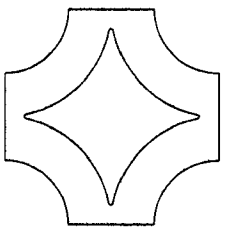
Figure 9I:
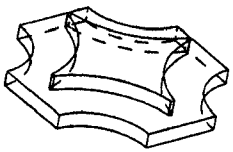
Figure 9J:
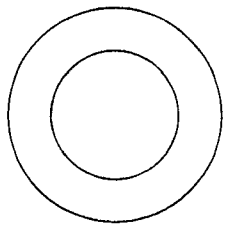
Figure 9K:
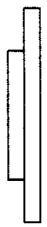
Figure 9L:
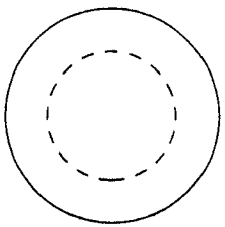
Figure 9M:
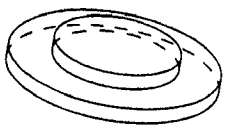
Figures 10A, 10B, 10C, 10D, 10E, 10F, 10G:
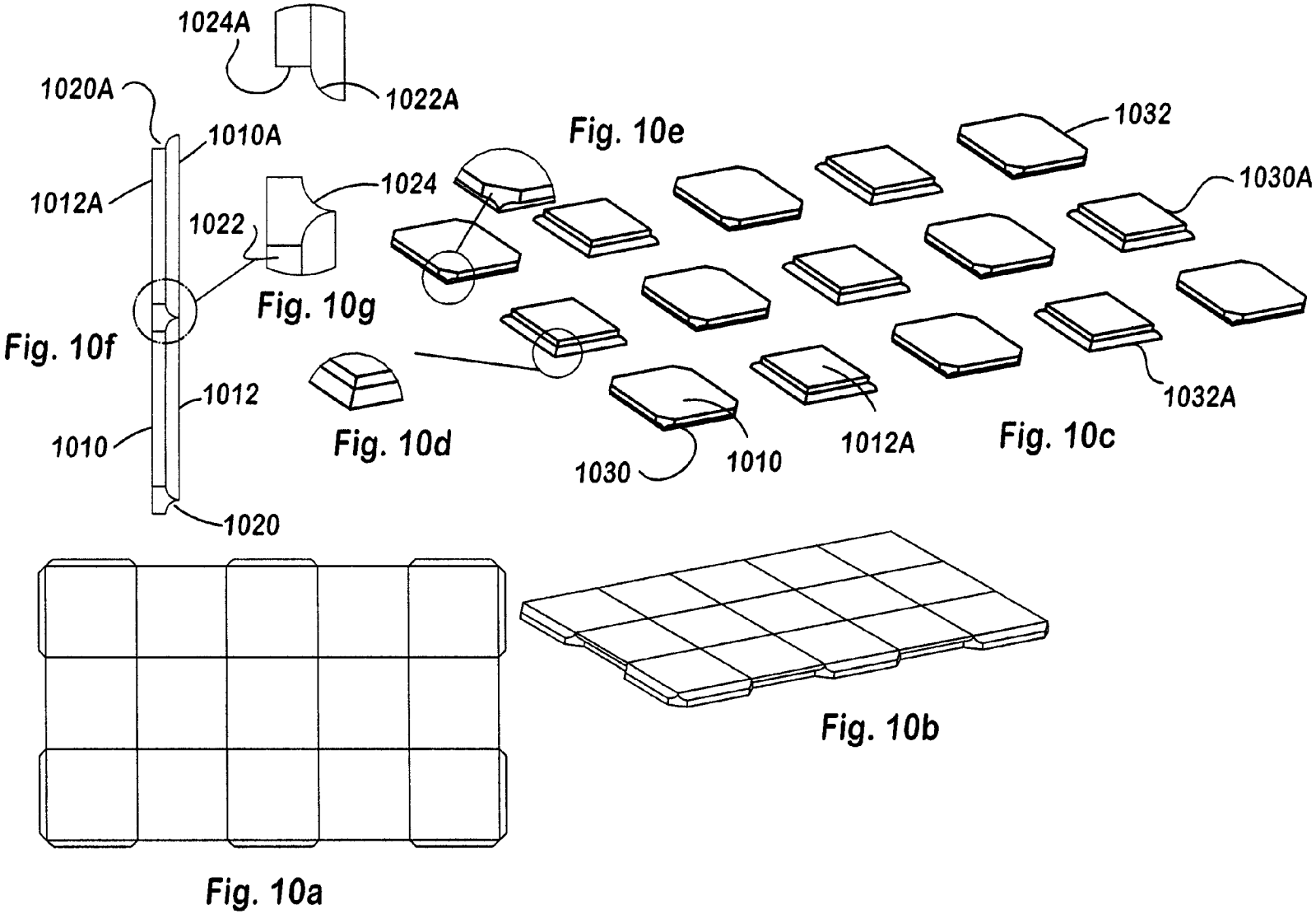
FIGS. 10*a*-10*p* are views of an eleventh tile system.
Figure 10K:
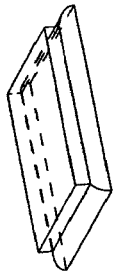
Figure 10P:
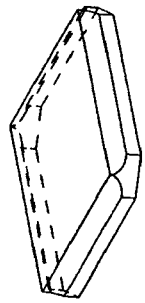
Figure 10J:
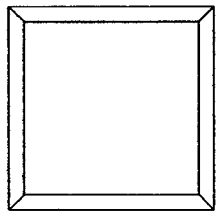
Figure 10O:
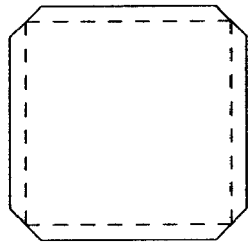
Figure 10I:
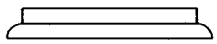
Figure 10N:
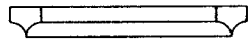
Figure 10H:
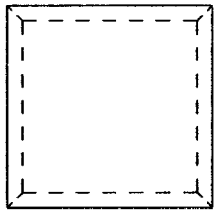
Figure 10M:
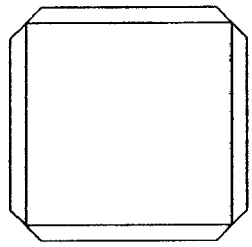
Figure 10L:
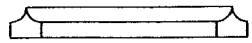

To provide for armor flexibility adjacent tiles have mating edge surfaces 520, but do not have interlocking edge surfaces in the sense that adjacent tiles can be tilted to some degree relative to one another in the manner of a hinge, as shown in FIG. 5*k*.

Advantageously, the tiles are of unitary construction, which is to say not constructed of plural laminated parts.

Manufacture

The tiles best are formed using standard power metallurgy techniques, particularly powder pressing processes using mechanical or hydraulic presses and using dies with outer configurations and/or top and or bottom punches and/or cavities that will produce a green body for an entire tile of a desired shape.

Frusto-pyramidal tiles, as described herein, are particularly well suited for efficient, high rate production by such standard powder pressing processes because there are no undercut portions in the edge surfaces. Such tiles can very conveniently be of unitary construction, which is to say not constructed from plural laminated parts.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims.

What is claimed is:

1. An armor tile suitable for use in an armor system for inhibiting penetration of ballistic projectiles, the tile comprising a body having:

a major face bounded by an edge at the perimeter of the major face, the edge comprising four long edge portions and four short edge portions, the short edge portions being shorter than the long edge portions, the long and short edge portion alternating progressively around the perimeter with adjacent long and short edge portions extending at an internal angle of about 135° relative to each other;

a minor face that is bounded by an edge at the perimeter of the minor face, that is generally everywhere equidistant from the major face, that has a smaller area than the major face, and that is positioned such that the perimeter of the minor face does not extend outwardly of the perimeter of the major face when the body is viewed facing normal to the minor face; and edge surfaces extending between the perimeters of the major and minor faces, the edge surfaces being shaped so that plural tiles can fit together edge-to-edge with the major and minor faces of one tile generally aligned respectively with the minor and major faces of an adjacent tile and with an edge surface of the one tile overlaying an edge surface of the adjacent tile, when viewed facing normal to faces of the tiles, with only a portion of the thickness of each tile overlapping so that the face-to-face thickness of a pair of tiles positioned edge-to-edge is no greater than the distance between the major and minor faces of one of the tiles, the edge surfaces being without any undercut portion, the edge surfaces not being completely planer from the perimeter of the major face to the perimeter of the minor face, and the edge surfaces being shaped such that the edge surface of the one tile generally conforms to the edge surface of the other tile when the pair of tiles is positioned edge-to-edge.

2. An armor tile of claim 1 wherein each edge surface has at least two bands that generally conform to the shapes of the edges of the major and minor faces respectively.

3. An armor tile of claim 2 wherein two of the bands extend at an angle relative to each other and meet at a corner that generally conforms to the shape of at least one of the face edges.

4. An armor tile of claim 2 wherein the bands are of generally uniform width around the entire perimeter of the tile.

5. An armor tile of claim 2 wherein one of the bands is a minor corner band extending from the perimeter of the minor face and another of the bands is a major corner band extending from the perimeter of the major face with each corner band extending at an angle from its corresponding face such that the corner band and the face meet at a corner.

6. An armor tile of claim 5 wherein each edge surface comprises a major corner band extending from the perimeter of the major face, a minor corner band extending from the perimeter of the minor face, and one or more bridging bands that extend between the major and minor corner bands.

7. An armor tile of claim 6 wherein each edge surface comprises a single bridging band that extends generally in parallel to the faces between the major and minor corner bands.

8. An armor tile of claim 1 wherein at least one of the major and minor faces defines a cavity for the purpose of weight reduction.

9. An array of armor tiles wherein:

the array comprises plural tiles of claim 1 arranged edge-to-edge with the major face of one tile generally aligned with the minor face of an adjacent tile; and an edge of the one tile overlays an edge of the adjacent tile when viewed facing normal to aligned faces of the tiles.

10. An armor tile of claim 1 further comprising at least one cavity defined in at least one of the faces or at least one raised area that extends from least one of the faces.

11. An armor tile of claim 6 wherein each edge surface comprises a single bridging band that extends at an angle other than about 90° to the faces between the major and minor corner bands.

12. The array of armor tiles of claim 9 wherein at least two of the adjacent tiles having overlaying edges are:

identical in shape; and in reversed orientation such that the major face of one of the tiles is generally aligned with the minor face of the adjacent tile.

13. A body armor garment configured to be worn by a human, the garment comprising an array of claim 9.

14. A body armor garment configured to be worn by a human, the garment comprising an array of claim 12.

15. An armor tile of claim 1 wherein:

the perimeter that defines the major face is an octagon;

the four long edge portions are of equal length;

the four short edge portions are of equal length; and the tile has an edge profile such that the edges of two identical tiles of claim 14 mate with one another with only a portion of the face-to-face thickness of each tile overlapping when one of the tiles is turned over and positioned edge-to-edge with the other tile with the major face of the one tile generally aligned with the minor face of the other tile.

16. An armor tile of claim 15 wherein the tile is substantially bilaterally symmetrical about three mirror lines including two mirror lines that extend generally in parallel to and midway between each pair of opposed perimeter edges of the major and minor faces and one mirror line that extends substantially normal to the major and minor faces at their centers.

17. An armor tile of claim 16 wherein:

the perimeter of the minor face is generally square and has four edge portions each of which extends generally parallel to the closest long edge portion of the major face with the minor face being centered within the perimeter of the major face when the body is viewed facing normal to the minor face; and the distance normal to and between each minor face edge portion and the closest long edge portion of the major face is substantially equal around the perimeter of the minor face when the body is viewed facing normal to the minor face.

18. An armor tile of claim 1 wherein the tile is substantially bilaterally symmetrical about three mirror lines including two mirror lines that extend generally in parallel to and midway between each pair of opposed perimeter edges of the major and minor faces and one mirror line that extends generally normal to the major and minor faces at their centers.

19. An armor tile of claim 2 wherein:

one of the bands is a major corner band extending from the perimeter of the major face and another of the bands is a minor corner band extending from the perimeter of the minor face with each corner band extending at an angle from its corresponding face; and at least a portion of the major corner band is substantially the same width as at least a portion of the minor corner band, with the widths being measured normal to the major face.

20. An armor tile of claim 19 wherein the entire major corner band is substantially the same width as the entire minor corner band, with the widths being measured normal to the major face.

21. An armor tile of claim 6 wherein:

the major corner bands extend generally normal to the major face; and the minor corner bands extend generally normal to the minor face.

22. An armor tile of claim 6 wherein, for each edge surface, the major corner band extends generally in parallel to the minor corner band.

23. An armor tile of claim 1 wherein:

the edge at the perimeter of the minor face is generally rectangular;

when the body is viewed facing normal to the minor face, the distance between a long edge portion of the perimeter of the major face and the nearest edge portion of the perimeter of the minor face, as measured normal to the edge portions, is the same at each edge of the four edge portions of the perimeter of the minor face; and for each edge surface, when the body is viewed facing the edge surface and generally parallel to the major and minor faces (a) the long edge portion of the perimeter of the major face is substantially the same length as the edge portion of the perimeter of the minor face and (b) the ends of the long edge portion of the perimeter of the major face respectively are aligned, normally to the major face, with the ends of the edge portion of the perimeter of the minor face.

24. An armor tile of claim 11 wherein each edge surface comprises a single bridging band that extends between the major and minor corner bands, with the bridging band intersecting minor corner band at an obtuse angle.

25. An armor tile of claim 1 wherein the major face and minor face are curved surfaces that are concentric.

* * * * *

UNITED STATES PATENT AND TRADEMARK OFFICE

CERTIFICATE OF CORRECTION

PATENT NO. : 7,793,579 B1
APPLICATION NO. : 12/186508
DATED : September 14, 2010
INVENTOR(S) : Robert G. Lee It is certified that error appears in the above-identified patent and that said Letters Patent is hereby corrected as shown below:

In the Specification:

Column 1, line 28, "fabrics. But" should read -- fabrics, but --.

Column 2, line 17, "multi hit" should read -- multi-hit --.

Column 2, line 66, "exhibit experience" should read -- experience --.

Column 3, lines 8-9, "one tile one the overlaying" should read -- one tile overlaying --.

Column 3, line 36, "embodiments configurations" should read -- configurations --.

Column 3, line 60, "to the to the" should read -- to the --.

In the Claims:

Column 6, line 27 (Claim 10), "from least" should read -- from at least --.

Column 6, line 47 (Claim 15), "claim 14" should read -- claim 1 --.

Signed and Sealed this
Twenty-fourth Day of June, 2014

Michelle K. Lee

Michelle K. Lee
*Deputy Director of the United States Patent and Trademark Office*